US011257428B2

(12) United States Patent
Cai

(10) Patent No.: US 11,257,428 B2
(45) Date of Patent: Feb. 22, 2022

(54) MIXED COMPENSATION CIRCUIT, CONTROL METHOD THEREOF, AND DISPLAY DEVICE

(71) Applicant: SHENZHEN CHINA STAR OPTOELECTRONICS SEMICONDUCTOR DISPLAY TECHNOLOGY CO., LTD., Shenzhen (CN)

(72) Inventor: Zhenfei Cai, Shenzhen (CN)

( * ) Notice: Subject to any disclaimer, the term of this patent is extended or adjusted under 35 U.S.C. 154(b) by 249 days.

(21) Appl. No.: 16/625,712

(22) PCT Filed: Dec. 6, 2019

(86) PCT No.: PCT/CN2019/123483

§ 371 (c)(1),
(2) Date: Dec. 22, 2019

(87) PCT Pub. No.: WO2021/103106

PCT Pub. Date: Jun. 3, 2021

(65) Prior Publication Data

US 2021/0407404 A1 Dec. 30, 2021

(30) Foreign Application Priority Data

Nov. 26, 2019 (CN) ..... 201911171661.X

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01)

(58) Field of Classification Search
None
See application file for complete search history.

(56) References Cited

U.S. PATENT DOCUMENTS

| | | | |
|---|---|---|---|
| 10,204,558 | B2 | 2/2019 | Chen et al. |
| 2017/0110055 | A1 | 4/2017 | Li et al. |
| 2017/0263184 | A1 | 9/2017 | Chen et al. |

FOREIGN PATENT DOCUMENTS

| | | | |
|---|---|---|---|
| CN | 101937647 | | 1/2011 |
| CN | 102982764 | A | 3/2013 |
| CN | 104751804 | A | 7/2015 |
| CN | 205080892 | U | 3/2016 |
| CN | 108335668 | A | 7/2018 |
| CN | 109256087 | | 1/2019 |
| WO | 2004088626 | A1 | 10/2004 |

*Primary Examiner* — Aneeta Yodichkas

(57) ABSTRACT

The present disclosure provides a mixed compensation pixel circuit, control method, and display device, the mixed compensation pixel circuit includes an internal compensation circuit and an external compensation circuit. The internal compensation circuit includes a first thin film transistor, a second thin film transistor, a third thin transistor, and a fourth thin transistor, the external compensation circuit includes a fifth thin transistor. By optimizing the pixel circuit architecture, the present disclosure does not have an NTFT with a positive long-term relative voltage, improves the stability of the circuit, simplifies the compensation process, and improves the accuracy of compensation.

14 Claims, 3 Drawing Sheets

Prior Art

MIXED COMPENSATION CIRCUIT, CONTROL METHOD THEREOF, AND DISPLAY DEVICE

FIELD OF INVENTION

The present disclosure relates to the field of display technologies, and more particularly to a mixed compensation circuit, a control method thereof, and a display device.

BACKGROUND OF INVENTION

Currently, N-type thin film transistors (n-TFT) usually use internal and external mixed compensation pixel circuits as shown in FIG. 1. An internal compensation operation time sequence of the mixed compensation pixel circuit is shown in FIG. 2. As shown in FIG. 2, the operation time sequence includes the following four steps:

P1, resetting step: resetting the gate-source of the driver T1.

P2, acquiring Vth (threshold voltage): inputting Vref (reference voltage) to node N1, and rising a voltage of node N2 to, VN2=Vref−Vth.

P3, inputting data: changing Node N1 from Vref to Vdata (data signal):

$$VN2=(\text{Vdata}-\text{Vref})*C1/(C1+C2)+\text{Vref}-\text{Vth}.$$

$$P4,\ \text{light-emitting: Vgs}=\text{Vdata}-(\text{Vdata}-\text{Vref})*C1/(C1+C2)-\text{Vref}+\text{Vth}.$$

During the light-emitting step, a thin film transistor is maintained at a high electrical potential (generally about 28 v). Because the organic light-emitting diode (OLED) is a current-driving device, the OLED needs to emit light during the pixel display process.

In other words, there is always a current flowing on the path of the four thin film transistors, so that the thin film transistor T4 operating under a large Vgs (relative voltage) voltage for a long time, however, the NTFT currently used for switching is usually made of an oxide semiconductor, which has poor stability, under long-term forward Vgs, reliability anomalies often occur, causing the circuit to fail to operate properly.

The external compensation time sequence as shown in FIG. 3., in the light-emitting step, an electrical potential of a gate (S3) of thin film transistor T4 needs to be high and maintaining at high (generally about 28 v), causing stability of the thin film transistor T4 to not work properly.

SUMMARY OF INVENTION

The present disclosure provides a mixed compensation pixel circuit, a control method thereof and a display device, solving the problem that in the light-emitting step, an electrical potential of a gate of thin film transistor T4 needs to be high and maintaining at high, causing a stability of the thin film transistor T4 still suffered severely tested.

In one aspect, the present disclosure provides a mixed compensation pixel circuit, including an internal compensation circuit and an external compensation circuit:

the internal compensation circuit includes a first thin film transistor, a second thin film transistor, a third thin film transistor, and a fourth thin film transistor, a gate of the first thin film transistor is connected to a first node, and a source and a drain of the first thin film transistor are respectively connected to a second node and a DC high voltage power supply, a gate of the second thin film transistor is connected to a third node, a source and a drain of the second thin film transistor are respectively connected to the second node and the DC high voltage power supply terminal, a source and a drain of the third thin film transistor are respectively connected to the first node and a reference voltage, and a source and a drain of the fourth thin film transistor are respectively connected to the third node and a data signal; and the external compensation circuit comprises a fifth thin film transistor, and a source and a drain of the fifth thin film transistor are respectively connected to the second node and a compensation voltage.

In the mixed compensation pixel circuit of the present disclosure, the internal compensation circuit further comprises a first capacitor and a second capacitor; and two terminals of the first capacitor are respectively connected to the first node and the second node, and the two terminals of the second capacitor are respectively connected to the third node and the second node.

In the mixed compensation pixel circuit of the present disclosure, the external compensation circuit further comprises a diode; and two terminals of the diode are respectively connected to the second node and a common ground voltage.

In one aspect, the present disclosure provides a control method implemented with a mixed compensation pixel circuit, wherein the mixed compensation pixel circuit comprises an internal compensation circuit and an external compensation circuit;

the internal compensation circuit includes a first thin film transistor, a second thin film transistor, a third thin film transistor, and a fourth thin film transistor, a gate of the first thin film transistor is connected to a first node, and a source and a drain of the first thin film transistor are respectively connected to a second node and a DC high voltage power supply, a gate of the second thin film transistor is connected to a third node, a source and a drain of the second thin film transistor are respectively connected to the second node and the DC high voltage power supply terminal, a source and a drain of the third thin film transistor are respectively connected to the first node and a reference voltage, and a source and a drain of the fourth thin film transistor are respectively connected to the third node and a data signal;

the external compensation circuit comprises a fifth thin film transistor, and a source and a drain of the fifth thin film transistor are respectively connected to the second node and a compensation voltage, the control method comprises:

performing internal compensation on the mixed compensation pixel circuit; and driving pixels to emit light according to the mixed compensation pixel circuit.

In the control method of the present disclosure, wherein performing internal compensation on the mixed compensation pixel circuit includes:

controlling the input reference voltage to obtain a threshold voltage; and controlling the input data signal to obtain a relative voltage according to the data signal and the threshold voltage, so as to control pixels to emit light according to the relative voltage.

In the control method of the present disclosure, performing internal compensation on the mixed compensation pixel circuit further includes:

resetting the gate and the source of the first thin film transistor.

In the control method of the present disclosure, controlling a pixel emits light according to the relative voltage includes:

writing data to the mixed compensation pixel circuit; and driving the pixels to emit light.

In the control method of the present disclosure, wherein writing data to the mixed compensation pixel circuit includes:

turning on the fifth thin film transistor and the fourth thin film transistor according to a gate line signal, to drive the second thin film transistor to be inputted with a relative voltage.

In the control method of the present disclosure, wherein driving the pixels to emit light, including:

turning off the fifth thin film transistor and the fourth thin film transistor according to a gate line signal, to make a current flow into an organic light emitting diode device through the second thin film transistor, thereby driving the pixels to emit light.

In one aspect, provides a display device including a mixed compensation pixel circuit.

The present disclosure has the following beneficial effects:

By optimizing the pixel circuit architecture, there is no long-term NTFT with a positive relative voltage, which improves the stability of the circuit, while simplifying the compensation process and improving the accuracy of compensation.

DESCRIPTION OF FIGURES

The present disclosure will be further described below with reference to the accompanying figures and embodiments. In the figures.

DETAILED DESCRIPTION OF PREFERRED EMBODIMENTS

In order to have a clearer understanding of the technical features, objects, and effects of the present disclosure, specific embodiments of the present disclosure will now be described in detail with reference to the figures.

Figure 1:
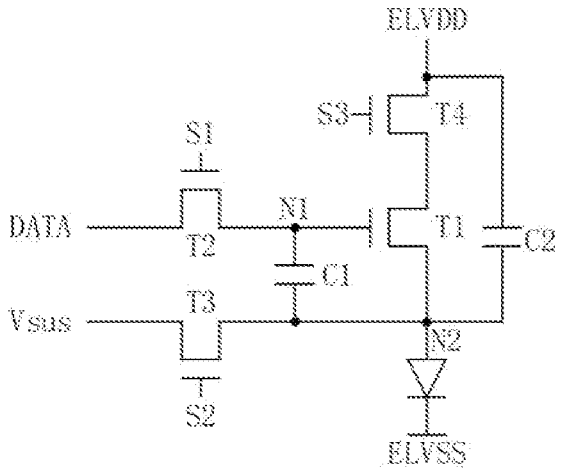
FIG. 1 Prior Art
FIG. 1 is a schematic structural diagram of a mixed compensation pixel circuit in the prior art.
Figure 2:
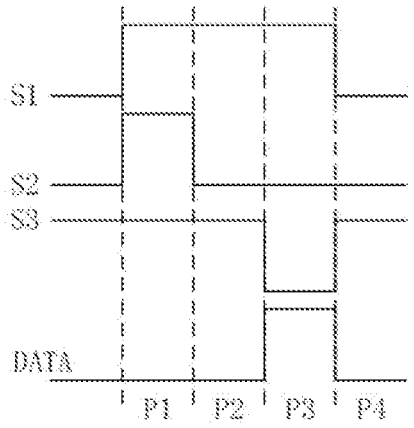
FIG. 2 is a time sequence diagram of internal compensation of the mixed compensation pixel circuit in the prior art.
Figure 3:
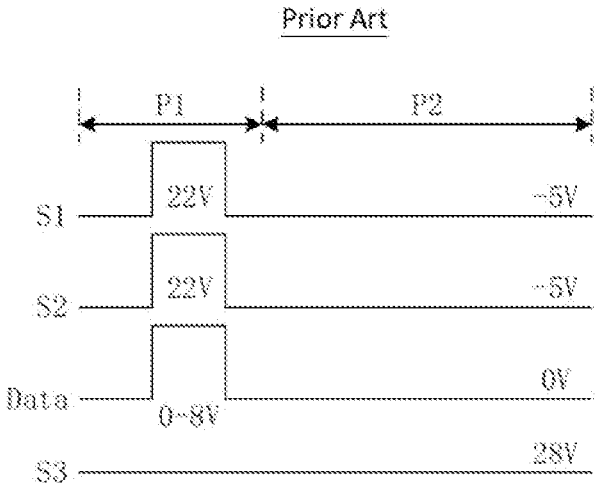
FIG. 3 is a time sequence diagram of external compensation of the mixed compensation pixel circuit in the prior art.
Figure 4:
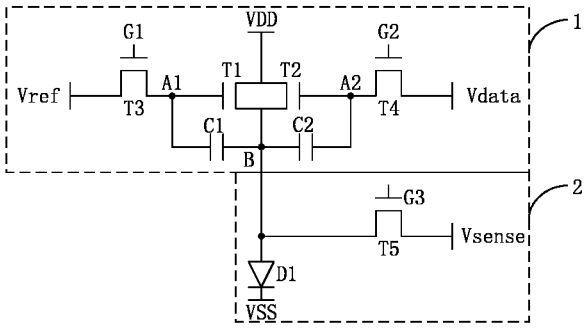
FIG. 4 is a schematic structural diagram of a mixed compensation pixel circuit provided by an embodiment of the present disclosure.

Referring to FIG. 4, FIG. 4 is a schematic structural diagram of a mixed compensation pixel circuit provided by an embodiment of the present disclosure. The mixed compensation pixel circuit includes an internal compensation circuit 1 and an external compensation circuit 2;

the internal compensation circuit 1 includes a first thin film transistor T1, a second thin film transistor T2, a third thin film transistor T3, and a fourth thin film transistor T4, a gate of the first thin film transistor T1 is connected to a first node A1, and a source and a drain of the first thin film transistor T1 are respectively connected to a second node B and a DC high voltage power supply VDD, a gate of the second thin film transistor T2 is connected to a third node A2, a source and a drain of the second thin film transistor T2 are respectively connected to the second node B and the DC high voltage power supply terminal VDD, a source and a drain of the third thin film transistor T3 are respectively connected to the first node A1 and a reference voltage Vref, and a source and a drain of the fourth thin film transistor T4 are respectively connected to the third node A2 and a data signal Vdata; and the external compensation circuit 2 includes a fifth thin film transistor T5, and a source and a drain of the fifth thin film transistor T5 are respectively connected to the second node B and a compensation voltage Vsense.

Preferably, the internal compensation circuit 1 further includes a first capacitor C1 and a second capacitor C2; and two terminals of the first capacitor C1 are respectively connected to the first node A1 and the second node B, and the two terminals of the second capacitor C2 are respectively connected to the third node A2 and the second node B.

Preferably, the external compensation circuit further comprises a diode D1, and two terminals of the diode D1 are respectively connected to the second node B and a common ground voltage VSS.

The present disclosure also provides a control method with a mixed compensation pixel circuit, which is implemented by using the mixed compensation pixel circuit as described above, and the control method includes steps S1-S2:

S1: performing internal compensation on the mixed compensation pixel circuit. Step S1 includes steps S11-S12:

S11: controlling the input reference voltage Vref to obtain a threshold voltage Vth.

Figure 5:
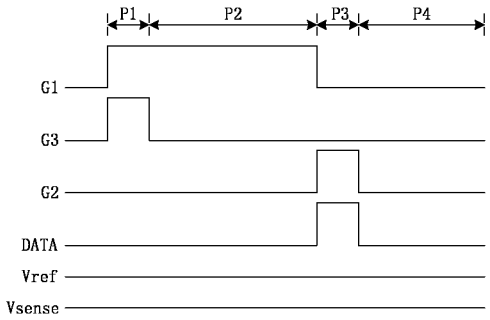
FIG. 5 is a time sequence diagram of internal compensation of a mixed compensation pixel circuit according to an embodiment of the present disclosure.

Referring to FIG. 5, FIG. 5 is a time sequence diagram of internal compensation of a mixed compensation pixel circuit according to an embodiment of the present disclosure. In the figure, P1 is a resetting step, P2 is a compensation step, P3 is a data writing step, and P4 is a light emitting step. In this embodiment, capturing the threshold voltage Vth, where the reference voltage Vref needs to be written to the first node A1, and raising a voltage at the second node B to VB=Vref−Vth. Acquiring threshold voltage corresponds to P2 of FIG. 5.

S12. controlling the input data signal Vdata to obtain a relative voltage according to the data signal Vdata and the threshold voltage, so as to control pixels to emit light according to the relative voltage Vgs.

In this embodiment, data writing step is: writing the data signal Vdata at the third node A2, and the relative voltage Vgs=Vdata−Vref+Vth at this time.

When emitting light: Vgs=Vdata−Vref+Vth−Vth, the threshold voltage Vth is eliminated at this time, and the threshold voltage Vth will not affect the pixel light emitting current loled. Writting data corresponds to P3 of FIG. 5, and controlling pixel light emission corresponds to P4 of FIG. 5.

Preferably, step S1 further includes step S10:

S10. Resetting the gate and source of the first thin film transistor T1.

In this embodiment, the first thin film transistor T1 is used as a driving transistor, and its gate and source need to be reset. Resetting the gate and source of the first thin film transistor T1 corresponds to P1 of FIG. 5.

S2: driving pixels to emit light according to the mixed compensation pixel circuit. Step S2 includes steps S21-S22:

S21: writing data to the mixed compensation pixel circuit.

Figure 6:
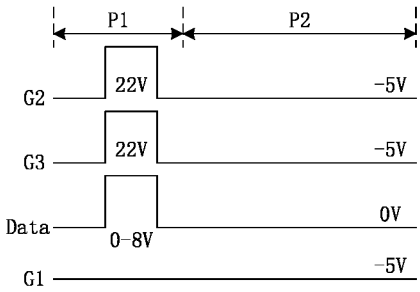
FIG. 6 is a time sequence diagram of external compensation of a mixed compensation pixel circuit according to an embodiment of the present disclosure.

Referring to FIG. 6, FIG. 6 is a time sequence diagram of external compensation of a mixed compensation pixel circuit according to an embodiment of the present disclosure.

In the figure, P1 is a data writing step, P2 is a light emitting step. Turning on the fifth thin film transistor T5 and the fourth thin film transistor T4 according to a gate line signal, to drive the second thin film transistor T2 to be inputted with a relative voltage. That is, this step corresponds to P1 of FIG. 6.

In this embodiment, in the data writing step: simultaneously turning on a gate signal line G2 corresponding to the fourth thin film transistor T4 and a gate signal line G3 corresponding to the fifth thin film transistor T5, and driving the second thin film transistor T2 to be inputted with a relative voltage Vgs.

S22: driving the pixels to emit light.

In this embodiment, turning off the fifth thin film transistor T5 and the fourth thin film transistor T4 according to a gate line signal, to make a current flow into an organic light emitting diode OLED device through the second thin film transistor T2, thereby driving the pixels to emit light. In the light emitting step, turning off the gate signal line G2 corresponding to the fourth thin film transistor T4 and the gate signal line G3 corresponding to the fifth thin film transistor T5 at the same time. The voltage across the capacitor bootstraps and the current flows into the OLED device through the fourth thin film transistor T4, and the pixels start emitting. This step corresponds to P2 of FIG. 6.

The present disclosure also provides a display device including the mixed compensation pixel circuit as described above.

The embodiments of the present disclosure have been described above with reference to the accompanying figures, but the present disclosure is not limited to the above specific implementations, and the above specific implementations are merely for schematic, not restrictive. People skilled in the art may, under the inspiration of the present disclosure, make many forms without departing from the spirit of the present disclosure and the scope of protection of the claims, which all fall within the protection of the present disclosure.

What is claimed is:

1. A mixed compensation pixel circuit, comprising an internal compensation circuit (1) and an external compensation circuit (2);

the internal compensation circuit (1) comprising a first thin film transistor (T1), a second thin film transistor (T2), a third thin film transistor (T3), and a fourth thin film transistor (T4); a gate of the first thin film transistor (T1) is connected to a first node (A1), and a source and a drain of the first thin film transistor (T1) are respectively connected to a second node (B) and a DC high voltage power supply (VDD); a gate of the second thin film transistor (T2) is connected to a third node (A2), a source and a drain of the second thin film transistor (T2) are respectively connected to the second node (B) and the DC high voltage power supply terminal (VDD); a source and a drain of the third thin film transistor (T3) are respectively connected to the first node (A1) and a reference voltage (Vref); and a source and a drain of the fourth thin film transistor (T4) are respectively connected to the third node (A2) and a data signal (Vdata); and the external compensation circuit (2) comprising a fifth thin film transistor (T5), and a source and a drain of the fifth thin film transistor (T5) are respectively connected to the second node (B) and a compensation voltage (Vsense).

2. The mixed compensation pixel circuit as claimed in claim 1, wherein the internal compensation circuit (1) further comprises a first capacitor (C1) and a second capacitor (C2); and two terminals of the first capacitor (C1) are respectively connected to the first node (A1) and the second node (B), and the two terminals of the second capacitor (C2) are respectively connected to the third node (A2) and the second node (B).

3. The mixed compensation pixel circuit as claimed in claim 1, wherein the external compensation circuit further comprises a diode (D1); and two terminals of the diode (D1) are respectively connected to the second node (B) and a common ground voltage (VSS).

4. A control method implemented with a mixed compensation pixel circuit, wherein the mixed compensation pixel circuit comprises an internal compensation circuit (1) and an external compensation circuit (2);

the internal compensation circuit (1) comprises a first thin film transistor (T1), a second thin film transistor (T2), a third thin film transistor (T3), and a fourth thin film transistor (T4), a gate of the first thin film transistor (T1) is connected to a first node (A1), and a source and a drain of the first thin film transistor (T1) are respectively connected to a second node (B) and a DC high voltage power supply (VDD), a gate of the second thin film transistor (T2) is connected to a third node (A2), a source and a drain of the second thin film transistor (T2) are respectively connected to the second node (B) and the DC high voltage power supply terminal (VDD), a source and a drain of the third thin film transistor (T3) are respectively connected to the first node (A1) and a reference voltage (Vref), and a source and a drain of the fourth thin film transistor (T4) are respectively connected to the third node (A2) and a data signal (Vdata);

the external compensation circuit (2) comprises a fifth thin film transistor (T5), and a source and a drain of the fifth thin film transistor (T5) are respectively connected to the second node (B) and a compensation voltage (Vsense), the control method comprises:

performing internal compensation on the mixed compensation pixel circuit; and driving pixels to emit light according to the mixed compensation pixel circuit.

5. The control method as claimed in claim 4, wherein performing internal compensation on the mixed compensation pixel circuit comprises:

controlling the input reference voltage (Vref) to obtain a threshold voltage; and controlling the input data signal (Vdata) to obtain a relative voltage according to the data signal (Vdata) and the threshold voltage, so as to control pixels to emit light according to the relative voltage.

6. The control method as claimed in claim 5, wherein performing internal compensation on the mixed compensation pixel circuit further comprises:

resetting the gate and the source of the first thin film transistor (T1).

7. The control method as claimed in claim 5, wherein controlling a pixel emits light according to the relative voltage comprises:

writing data to the mixed compensation pixel circuit; and driving the pixels to emit light.

8. The control method as claimed in claim 7, wherein writing data to the mixed compensation pixel circuit comprises:

turning on the fifth thin film transistor (T5) and the fourth thin film transistor (T4) according to a gate line signal, to drive the second thin film transistor (T2) to be inputted with a relative voltage.

9. The control method as claimed in claim 7, wherein driving the pixels to emit light, comprising:

turning off the fifth thin film transistor (T5) and the fourth thin film transistor (T4) according to a gate line signal, to make a current flow into an organic light emitting diode (OLED) device through the second thin film transistor (T2), thereby driving the pixels to emit light.

10. The control method as claimed in claim 4, wherein the internal compensation circuit (1) further comprises a first capacitor (C1) and a second capacitor (C2), two terminals of the first capacitor (C1) are respectively connected to the first node (A1) and the second node (B), and two terminals of the second capacitor (C2) are respectively connected to the third node (A2) and the second node (B).

11. The control method as claimed in claim 4, wherein the external compensation circuit further comprises a diode (D1); and two terminals of the diode (D1) are respectively connected to the second node (B) and a common ground voltage (VSS).

12. A display device comprising a mixed compensation pixel circuit, wherein the mixed compensation pixel circuit comprises an internal compensation circuit (1) and an external compensation circuit (2);

the internal compensation circuit (1) comprises a first thin film transistor (T1), a second thin film transistor (T2), a third thin film transistor (T3), and a fourth thin film transistor (T4), a gate of the first thin film transistor (T1) is connected to a first node (A1), and a source and a drain of the first thin film transistor (T1) are respectively connected to a second node (B) and a DC high voltage power supply (VDD), a gate of the second thin film transistor (T2) is connected to a third node (A2), a source and a drain of the second thin film transistor (T2) are respectively connected to the second node (B) and the DC high voltage power supply terminal (VDD), a source and a drain of the third thin film transistor (T3) are respectively connected to the first node (A1) and a reference voltage (Vref), and a source and a drain of the fourth thin film transistor (T4) are respectively connected to the third node (A2) and a data signal (Vdata);

the external compensation circuit (2) comprises a fifth thin film transistor (T5), and a source and a drain of the fifth thin film transistor (T5) are respectively connected to the second node (B) and a compensation voltage (Vsense).

13. The display device as claimed in claim 12, wherein the internal compensation circuit (1) further comprises a first capacitor (C1) and a second capacitor (C2);

two terminals of the first capacitor (C1) are respectively connected to the first node (A1) and the second node (B), and two terminals of the second capacitor (C2) are connected to the third node (A2) and the second node (B).

14. The display device as claimed in claim 12, wherein the external compensation circuit further comprises a diode (D1); and two terminals of the diode (D1) are respectively connected to the second node (B) and a common ground voltage (VSS).

* * * * *